US009469012B1

(12) United States Patent
le Blanc et al.

(10) Patent No.: US 9,469,012 B1
(45) Date of Patent: Oct. 18, 2016

(54) SPHERICAL LAPPING MACHINE

(71) Applicants: Pieter le Blanc, Rancho Cordova, CA (US); Elena Pinto, Rancho Cordova, CA (US)

(72) Inventors: Pieter le Blanc, Rancho Cordova, CA (US); Elena Pinto, Rancho Cordova, CA (US)

( * ) Notice: Subject to any disclaimer, the term of this patent is extended or adjusted under 35 U.S.C. 154(b) by 0 days.

(21) Appl. No.: 14/805,975

(22) Filed: Jul. 22, 2015

(51) Int. Cl.
*B24B 37/00* (2012.01)
*B24B 37/025* (2012.01)

(52) U.S. Cl.
CPC ..... *B24B 37/025* (2013.01)

(58) Field of Classification Search
CPC ..... B24B 37/025; B24B 11/08; B24B 11/10; B24B 11/02; A63B 45/00
USPC ..... 451/50
See application file for complete search history.

(56) References Cited

U.S. PATENT DOCUMENTS 1,448,239 A * 3/1923 Schuessler ..... B23Q 35/105 451/123
1,694,900 A * 12/1928 Zimmerling ..... A63B 45/00 451/259
1,936,808 A * 11/1933 Townsend ..... B24B 11/02 409/903
2,982,057 A * 5/1961 Stanhope ..... B24B 11/00 451/180
3,024,578 A * 3/1962 Mushkin ..... B24B 11/10 451/268
3,088,254 A * 5/1963 Lipkins ..... B24D 7/005 144/24.09
3,111,789 A * 11/1963 Harmon ..... B24B 11/10 451/180
3,133,383 A * 5/1964 Chapman ..... B24B 11/10 451/268
3,151,419 A * 10/1964 Ray ..... B24B 11/10 451/180
3,465,445 A 9/1969 Fisher
3,889,426 A * 6/1975 Blum ..... B24B 13/005 451/159
4,914,865 A * 4/1990 Wiand ..... B24B 13/02 384/906
5,024,024 A * 6/1991 Watanabe ..... B24B 13/00 451/277
5,131,190 A 7/1992 Gougouyan
5,593,340 A * 1/1997 Nelson ..... B24B 13/01 451/42
5,697,832 A 12/1997 Greenlaw
6,071,179 A * 6/2000 Sakai ..... B24B 37/02 451/324
6,077,148 A * 6/2000 Klein ..... B24B 1/00 451/11
6,439,982 B1 * 8/2002 Klukos ..... B24B 11/02 451/307
6,596,395 B1 * 7/2003 Muramatsu ..... B24B 37/025 428/402
7,892,073 B1 * 2/2011 Smania ..... B24B 11/10 15/21.2
8,062,098 B2 11/2011 Duescher

* cited by examiner

*Primary Examiner* — George Nguyen
(74) *Attorney, Agent, or Firm* — Vincent G. LoTempio; Kloss, Stenger & LoTempio; David T. Stephenson

(57) ABSTRACT

A lapping machine that can reproduce novel lapping patterns for generally spherical workpieces. The lapping machine replicates the motions commonly used in manual lapping, but with full reproducibility. The desired patterns of lapping are representative of roulette curves, and the present disclosure describes a novel means to produce roulette curve lapping of spherical workpieces by machine. The lapping machine may utilize a free rolling spherical lap arrangement in the lower unit and a telescopic rod and spherical lap in an upper unit. Different tools for holding the workpiece allow for easy adjustment to a variety of work piece sizes and shapes.

20 Claims, 19 Drawing Sheets

SPHERICAL LAPPING MACHINE

BACKGROUND

The present disclosure relates to lapping of spherical objects and specifically to a lapping machine that utilizes patterns of movement of a lapping disc to customize the production of perfectly spherical objects.

Lapping is a process in which surfaces are rubbed together with an abrasive between them, typically performed by a lapping machine. A lapping machine uses an abrasive surface to smooth a workpiece. The most common type of lapping machine currently in use for creating precision spherical shapes utilizes two large discs rotating in parallel, between which the spherical objects are being lapped. One of the lapping discs is typically grooved. During lapping, abrasive slurry is introduced between the upper and lower discs to provide an abrasive action to smooth spherical objects. As a spherical object is lapped, it reduces in size, allowing it to travel down the groove until it exits the lapping machine at a certain size. The dimensions of the lapping disc grooves determine the ultimate size of the spherical workpiece.

The lapping process described above is typically used for mass production of spherical objects. The set up and design of the discs and machines for a typical lapping process is expensive to adjust for shape or size. The high volumes produced in the typical lapping operation allow for a profit that can overcome the high cost of adjusting the equipment for each different batch of spherical objects.

Another type of lapping involves probes of coordinate measuring machines (CMMs). Using coordinate measuring machines requires touch probes which, over time, accumulate materials shredded from the surfaces to be measured. They need to be re-constituted in a precise fashion not feasible with conventional spherical lapping equipment.

Existing lapping machines lack the ability to easily match lapping of spherical components in a ball and socket geometry. Ball and socket geometry is desirable in replacement joint geometries, such as a hip joint, or matched bearing sets for high precision component alignment and high speed rotation. Recent advances in the use of implantable prosthetic joints to replace natural joints in humans have resulted in great advances in treatment of patients. Many designs for such prosthetic implants, particularly for the hip joint, require a spherical head having an extremely smooth surface to reduce friction and increase the life of the joint.

Existing technologies for machining spherical parts on a ball grinder often result in a relatively rough surface. The resulting spherical parts may be buffed to achieve a more polished surface. A problem with currently existing buffing technologies, however, is that surface irregularities, such as grinding and buffing lines, remain on the finished part. Buffing by hand is inferior to machine buffing or lapping, and it is both labor intensive and time consuming, resulting in high costs for the finished spherical product. Additionally, manual buffing and lapping yields lower precision and cannot be considered repeatable processes.

SUMMARY

The present disclosure overcomes the limitations of existing lapping machines by introducing a lapping machine that can perform novel machine lapping patterns for generally spherical workpieces. The present disclosure, in the preferred embodiment, utilizes a free rolling spherical lap arrangement in the lower unit and a telescopic rod and spherical lap in the upper unit. The upper unit may serve to hold the sphere in place during rotation. Different tools for holding the workpiece, or piece to be lapped, allow for easy adjustment to a variety of workpiece sizes and shapes.

The vertical operation of the present disclosure differs from existing lapping techniques in that it eliminates side loads induced by gravity. The upper unit of the lapping machine may include a unique geared drive mechanism that utilizes an elliptical gear drive train. Precision belt configurations allow for the upper and lower unit to be driven by a single micro-stepper motor. The micro-stepper motor is controlled by a programmable Stac5 controller/driver and by means of two precision belt configurations. This type of power transmission prevents motor vibrations from affecting workpiece quality and supports a high precision lapping motion.

The micro-stepper motor, in the preferred embodiment, is located between the two structural upright members on an adjustable platform. This platform can be adjusted in two axes in a single plane, ensuring perfect alignment with the lower unit pulley drive shaft (50/s6) via a coupling. The upper unit belt drive is also equipped with a free running belt tension adjustment. The micro-stepper motor is equipped with an absolute encoder, providing continuous feedback to the controller regarding motor speed and torque in relationship to programmed speed. This feedback mechanism is responsible for stall prevention of the system due to excessive load at the motor shaft. The feedback makes it impossible for the drive to skip steps and thus maintain repeatability from cycle to cycle.

The upper unit containing the elliptical gear drive mechanism is driven by means of a precision timing belt by the micro-stepper motor. The belt drive reduces noise, prevents transmission of vibration, is long lasting and prevents slippage between the motor and the gear drive mechanism. The belt drives the upper unit main shaft to which a central gear is attached. Above the gear on the main shaft rotates the gear satellite assembly with its own angular contact bearing/trust bearing combination.

The stepper motor is driven by a Stac5 controller/driver. Motion profiles can be written on a PC, laptop or tablet and can be uploaded via a CAT5e data cable attached to the CAT5e jack into the controller for autonomous execution. Additionally, the machine can also be controlled remotely thru an Ethernet connection as part of a series of machines (up to 10) with individual Ethernet addresses. This offers flexibility to the person in charge to control each machine separately to run a potentially different motion profile as required for a specific job or as a set of consecutive finer lapping processes. The program start is activated by a green momentary cycle start button, visible on the right side of the machine and mounted on the controller enclosure.

The lapping machine of the present disclosure can also be adapted to allow CMM probe tips to be re-polished and metal traces removed. Further, the lapping machine of the present disclosure can be scaled up for larger components or designed in such a way that the upper rotating unit can be moved to different positions in relationship to the lower unit.

Currently, manual lapping is used to achieve the highest degree of symmetry and smoothness for certain workpieces. The present disclosure describes a lapping machine that replicates the motions commonly used in manual lapping, but with full reproducibility. The desired patterns of lapping are representative of roulette curves, and the present disclosure describes a novel means to produce roulette curve lapping of spherical workpieces by machine. A limitation of manual lapping, in addition to high labor costs, is a lack of reproducibility of the desired lapping pattern. The lapping machine of the present disclosure provides reproducibility in the three areas of control required for proper lapping: lapping motion, lapping pressure and lapping duration.

One object of the invention is to provide a lapping machine having two units; utilizing a spherical lap in the lower unit and a telescopic spherical lap in the upper unit.

Another object of the invention is to provide a lapping machine that can be adapted to allow CMM probe tips to be serviced.

A further object of the invention is to provide a lapping machine that can easily be scaled up for larger components.

A further object of the invention is to provide a lapping machine with an upper unit that can be moved to any vertical position in relationship to the lower unit.

A further object of the invention is to provide a lapping machine that replicates the manual orbital motion currently employed to produce generally spherical objects.

A further object of the invention is to provide a lapping machine with programmable independent upper and lower unit speed controls.

A further object of the invention is to provide a lapping machine that can handle larger collet sizes, such as 5C, for work holding of larger components.

A further object of the invention is to provide a lapping machine that allows fully programmable acceleration, deceleration, velocity profiles and durations during lapping cycles.

DESCRIPTION OF DRAWINGS

The present invention and the manner in which it may be practiced is further illustrated with reference to the accompanying drawings wherein.

DETAILED DESCRIPTION

Figure 1:
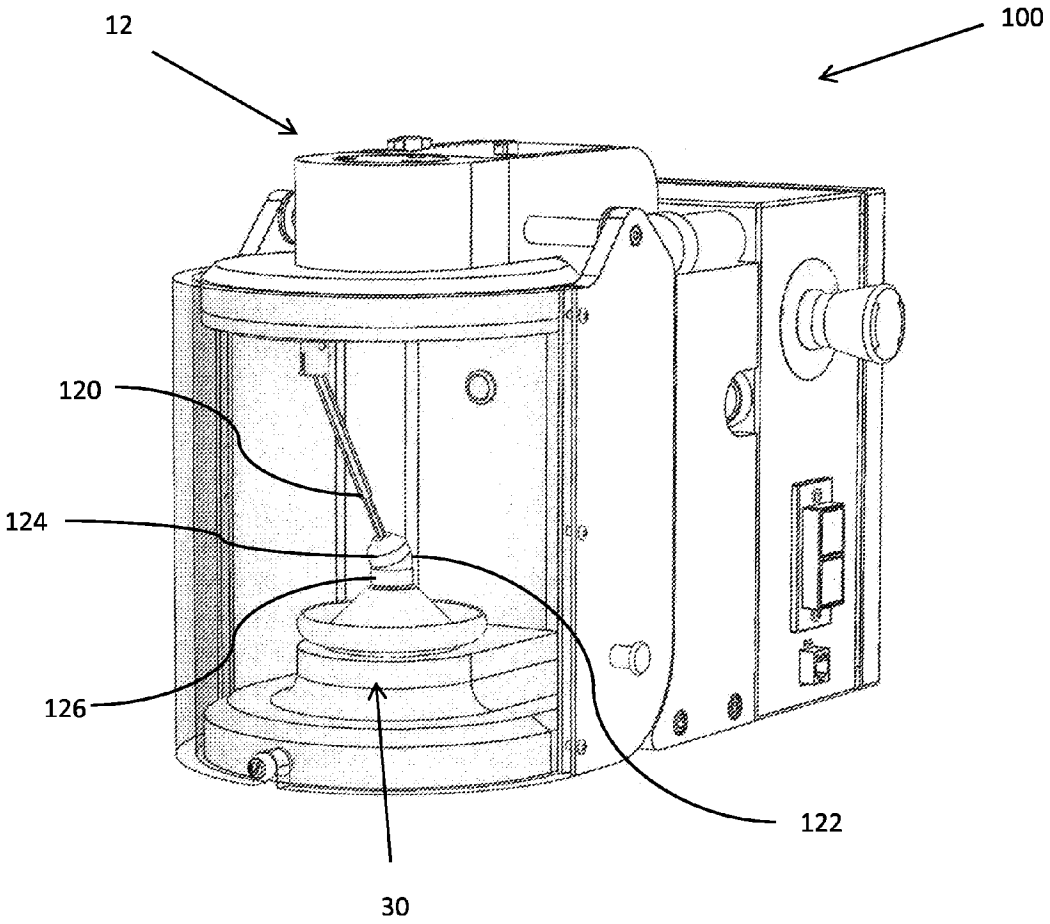
FIG. 1 is a front perspective view of the lapping machine.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112. As used in the following description, the terms "horizontal", "vertical", "left", "right", "up", "down", as well as adjectival and adverbial derivatives thereof (e.g., "horizontally", "vertically", "upwardly", etc.) simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 2:
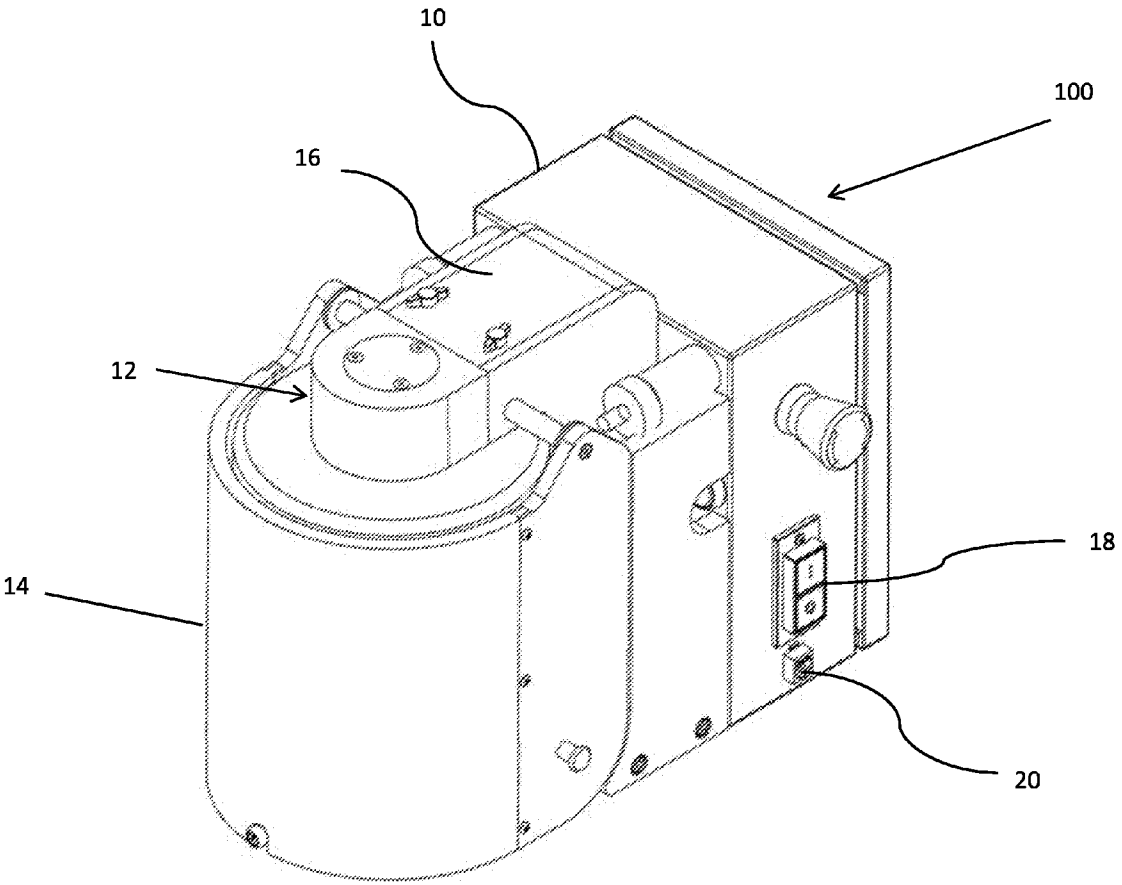
FIG. 2 is a top perspective view of the lapping machine.

FIGS. 1-5 show external views, from various perspectives, of lapping machine 100. FIG. 1 shows a perspective view of an exemplary version of lapping machine 100. A telescopic rod 120 can be seen extending between a lower unit 30 toward an upper unit 12. Between upper concave lap 124 and lower concave lap 126 is workpiece 122. FIG. 2 shows a vertical drive train motor casing 16, which connects upper unit 12 and lower unit 30. A housing 10 encloses components for lapping machine 100. Upper unit 12 and vertical motor casing 16 contain components that control movement within lapping machine 100.

The upper unit 12 (shown in FIG. 1) of the lapping machine may include a unique geared drive mechanism that utilizes an elliptical gear drive train. Precision belt configurations allow for the upper and lower unit to be driven by a single micro-stepper motor housed in vertical motor casing 16. The micro-stepper motor is, in the preferred embodiment, controlled by a programmable Stac5 controller/driver and by means of two precision belt configurations. This type of power transmission prevents motor vibrations from affecting workpiece quality and supports a high precision lapping motion.

The micro-stepper motor, in the preferred embodiment, is located between the two structural upright members on an adjustable platform in vertical motor casing 16 (shown in FIG. 2). This platform can be adjusted in two axes in a single plane, ensuring perfect alignment with the lower unit pulley drive shaft (50/s6) via a coupling. The upper unit belt drive is also equipped with a free running belt tension adjustment. The micro-stepper motor may be equipped with an absolute encoder, providing continuous feedback to the controller regarding motor speed and torque in relationship to programmed speed.

In FIG. 2, a clear acrylic safety shield 14 prevents access to moving parts within lapping machine 100 to prevent injury during operation and houses an electromagnetic switch which temporarily stops motion when the safety shield 14 is opened. Power up breaker 18 serves to activate or deactivate lapping machine 100. Communication port 20 allows for programmed control and/or autonomous control program upload for operation of lapping machine 100.

Figure 3:
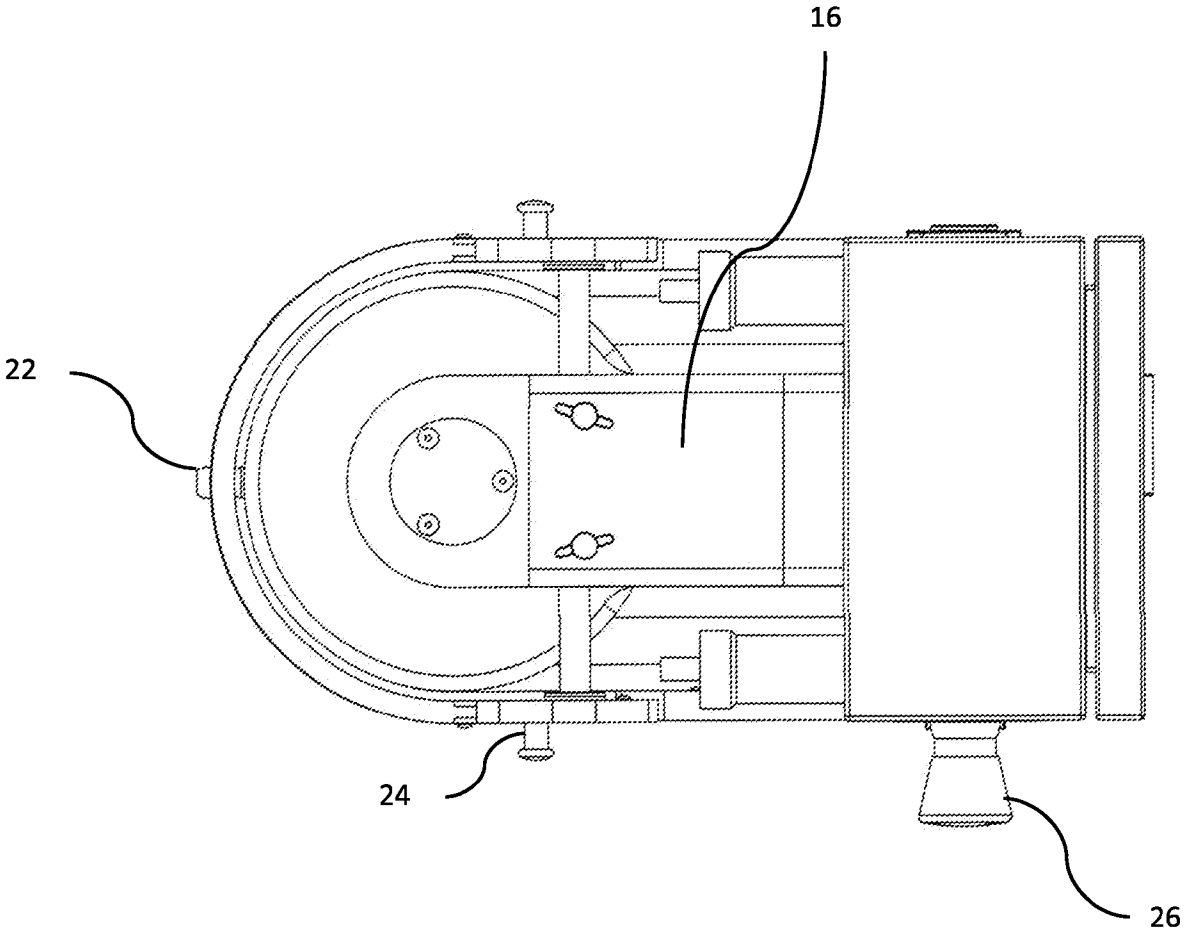
FIG. 3 is a top view of the lapping machine.
Figure 4:
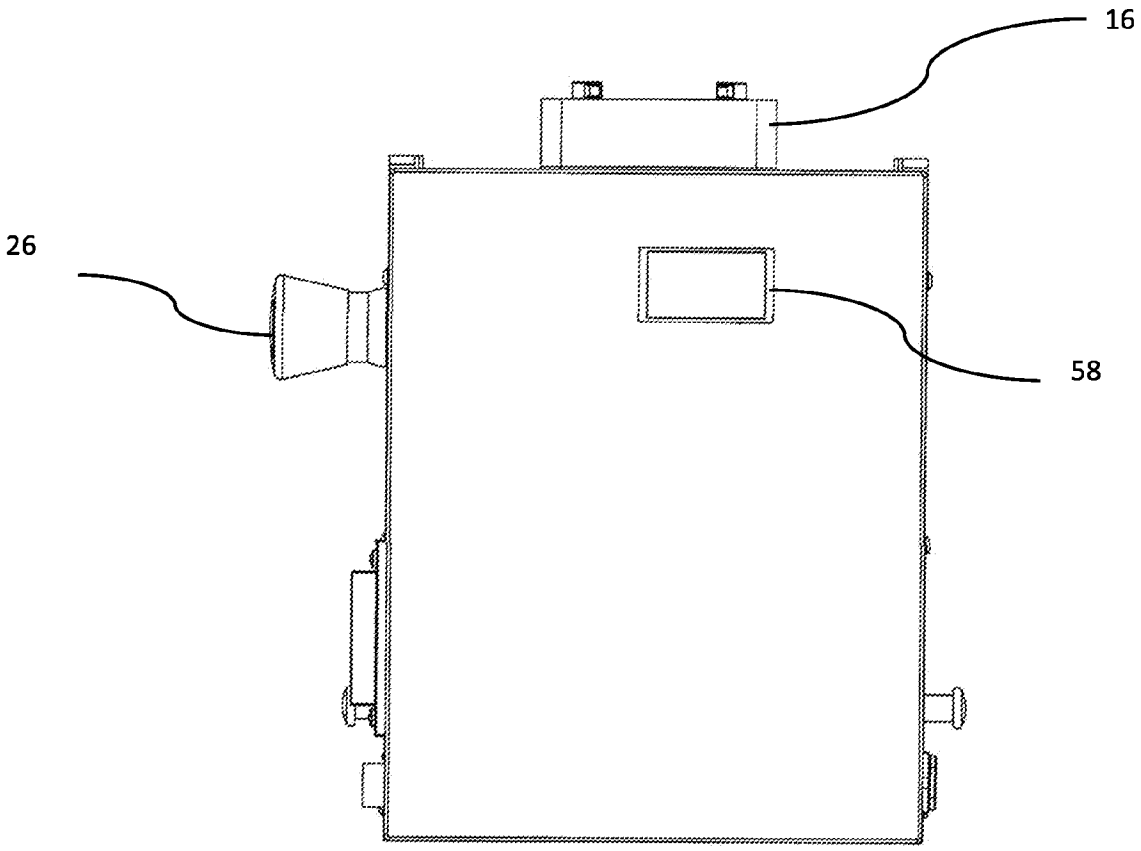
FIG. 4 is a rear elevational view of the lapping machine.
Figure 5:
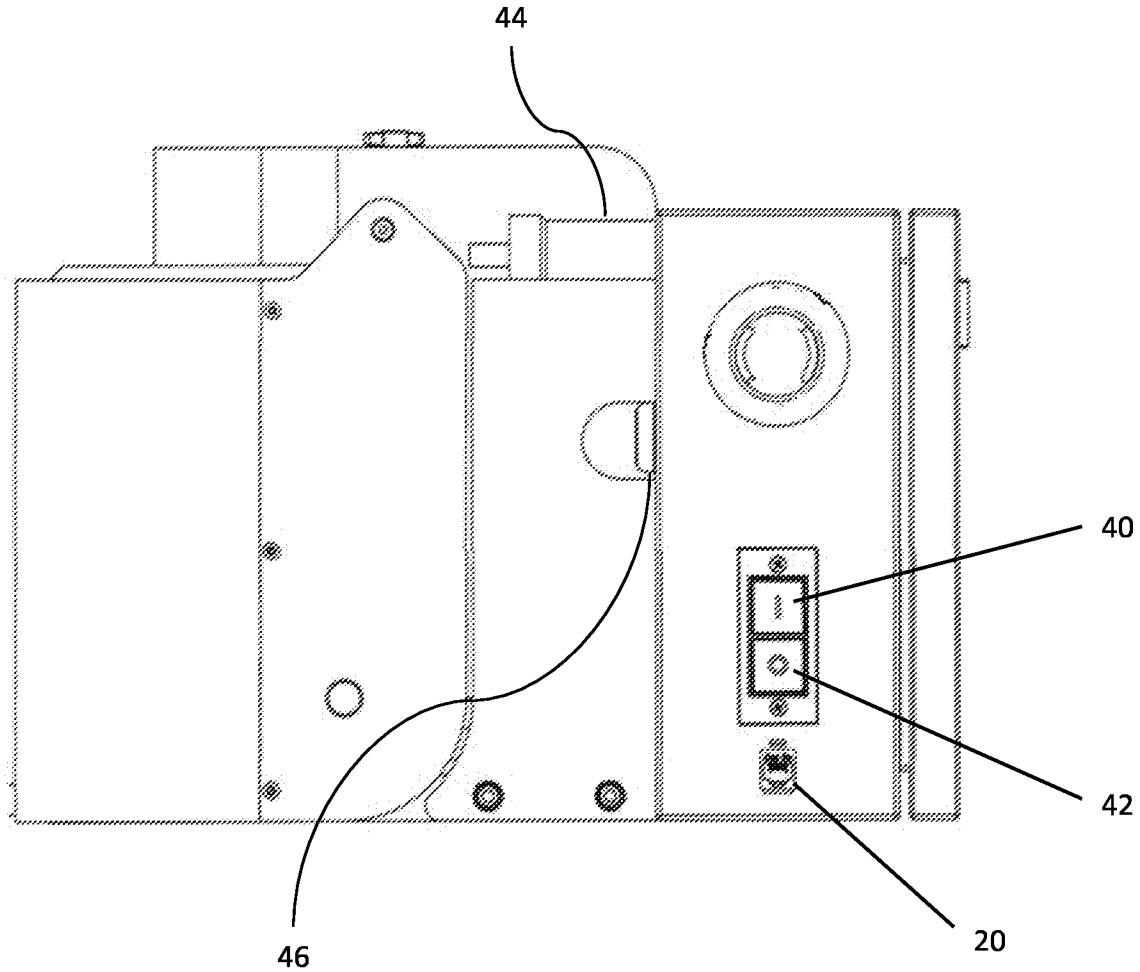
FIG. 5 is a side elevational view of the lapping machine.

FIG. 3 shows a top view of lapping machine 100 illustrating the emergency stop switch 26 and safety shield lift knob 24. Collet closer 22 allows for tightening of t-collets compatible with lapping machine 100. Rear elevational view (FIG. 4) illustrates vertical motor casing 16 and emergency stop switch 26, along with hour meter 58. A side elevational view (FIG. 5) shows system start switch 40 and stop switch 42. Snubber 44 dampens the closure of the safety shield during operation of lapping machine 100. Push button switch 46 starts/restarts the lapping cycle.

Figure 6:
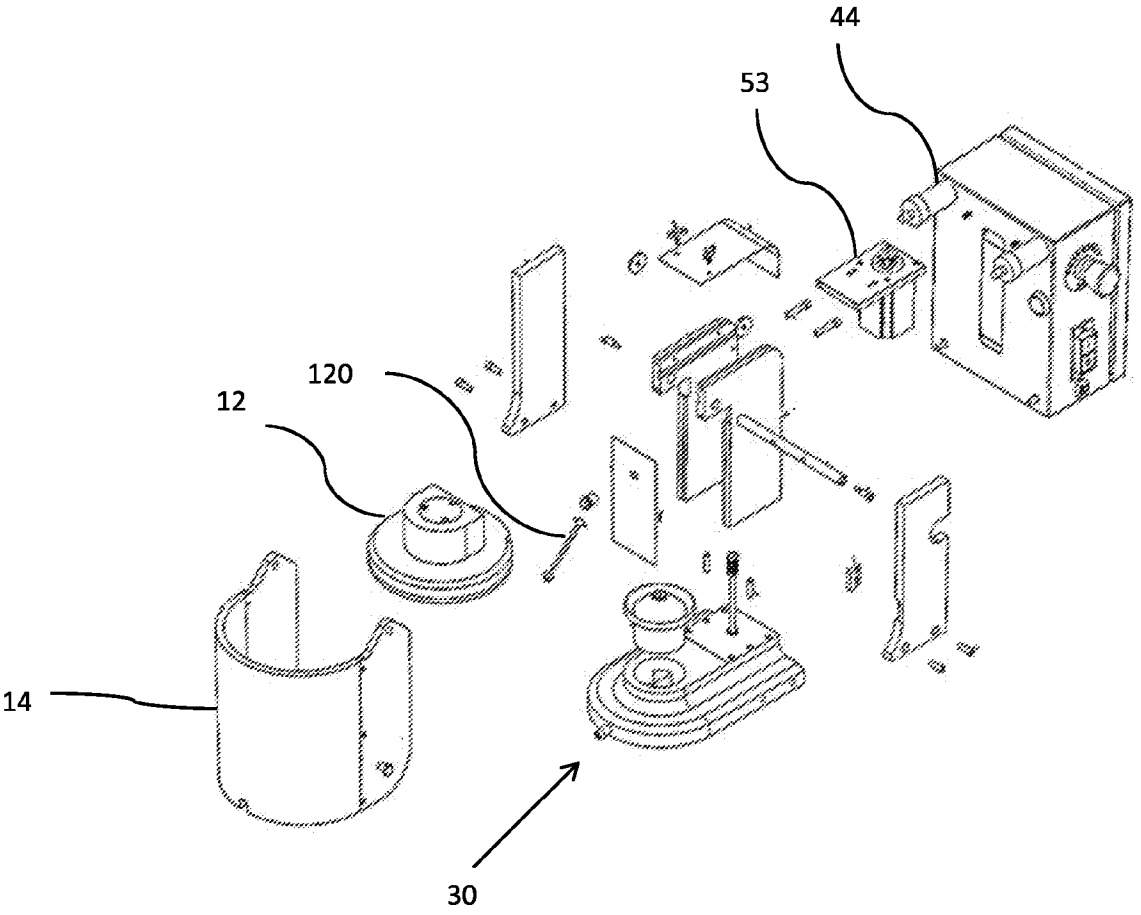
FIG. 6 is an exploded perspective view of the lapping machine.

FIG. 6 shows an exploded view of lapping machine 100. spring-loaded telescopic rod 120 is removably attached between lower unit 30 and upper unit 12 to keep the lap in contact with workpiece 122.

Figure 7:
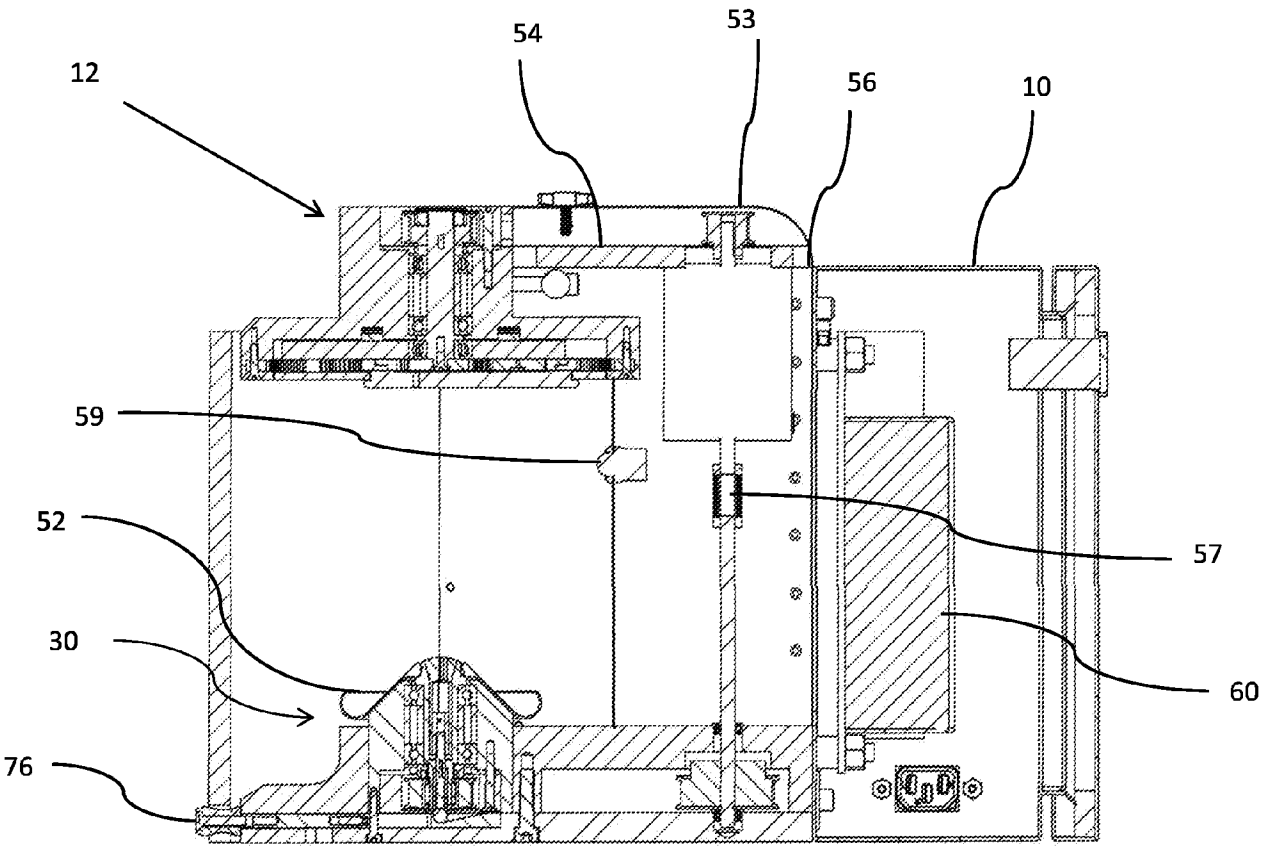
FIG. 7 is cross-sectional side view of the lapping machine.

FIG. 7 shows cross-sectional side view of lapping machine 100. A servo drive assembly 53 is contained within vertical motor casing 16 along with shaft coupler 57. Floating motor mount 54 is adjacent to servo drive assembly 53. Drive controller 60 is contained within housing 10.

Figure 8A:
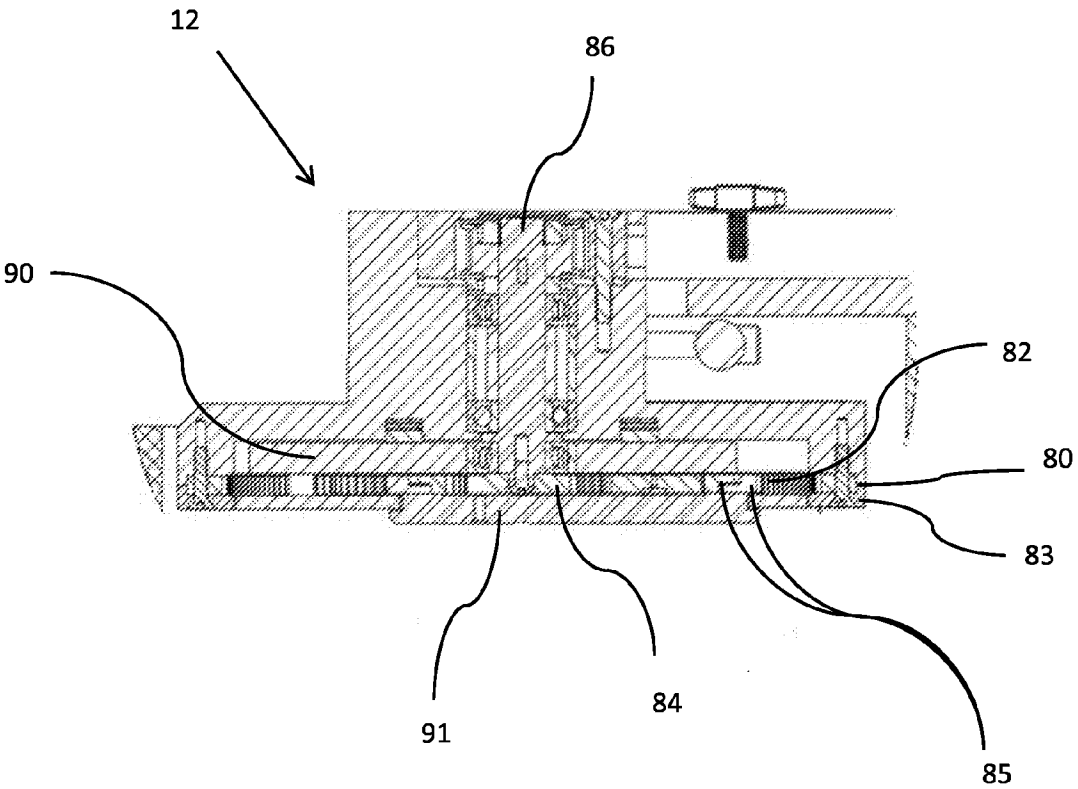
FIG. 8A is cross-sectional side view of the upper unit.

FIG. 8A shows a magnified cross sectional view of the upper unit 12. The upper unit main spindle 86 is driven by a maintenance-free precision timing belt and upper unit timing belt pulley. Both the upper unit main spindle 86 and lower unit main spindle 93 (see FIG. 9) are supported by super-precision preloaded angular contact bearings in order to eliminate additional run-out at the working ends of the spindles as one would face using regular ball bearings.

Figure 8B:
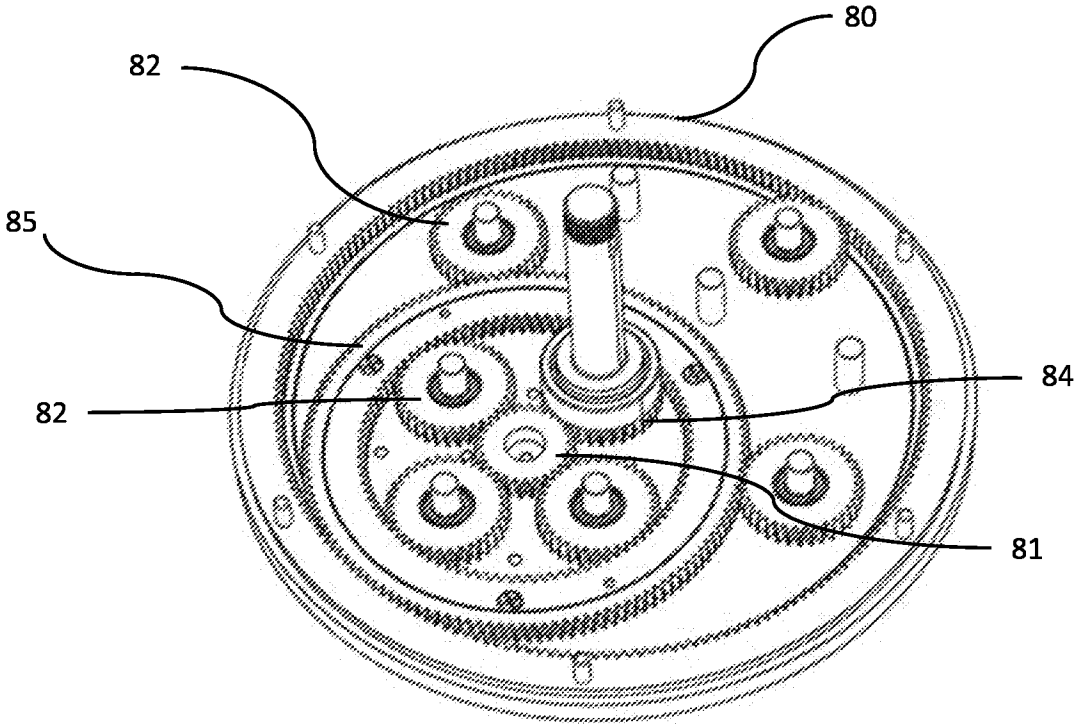
FIG. 8B is a perspective view of the gear system in the upper unit of lapping machine 100.

FIG. 8B shows the upper unit main drive gear 84 on the main shaft engaging three other gears of the same size and remains in mesh via a smaller floating central gear 81. These five gears all mesh inside a combination gear 85 which is permanently in contact with a larger external ring gear 80. In the preferred embodiment, the ring gear 80 has 192 teeth and meshes with a combination gear 85 having 130 teeth. Combination gear 85 is free to walk completely around the inside of ring gear 80, ring gear 80 being static, but is constrained by five pilot gears 82 to keep it centered.

Three of the five pilot gears 82 are in mesh with each other, the upper unit main drive gear 84 and the I.D. of the combination gear 85. Two of the five pilot gears are in mesh with the O.D. of combination gear 85 and are mounted on eccentric shafts which allow gear train backlash to be minimized. Ring gear 80 is rendered immobile by means of gear cover 83. An orbital disc 91 with threaded apertures is attached to this combination gear 85 and allows the operator to thread the universal telescopic rod socket in any of the 17 locations giving 17 distinctly different composite motions.

The entire drive train is mounted on mounted on a backplane, which can freely rotate around upper unit main spindle 86. Motion of the backplane is constrained between an angular contact bearing and a large diameter trust bearing.

Orbital disc 91 (shown in FIG. 8A) is attached concentrically to combination gear 85, and together they are constrained by a cover plate; which rotates in unity with backplane 89. Orbital disc 91 follows the same motion as combination gear 85, creating a plurality of patterns according to the marked threaded aperture locations (shown in FIGS. 13-16). Universal telescopic rod socket 132 (shown in FIG. 13) can be placed in any of 17 threaded apertures, each resulting in a unique lapping pattern.

Figure 9:
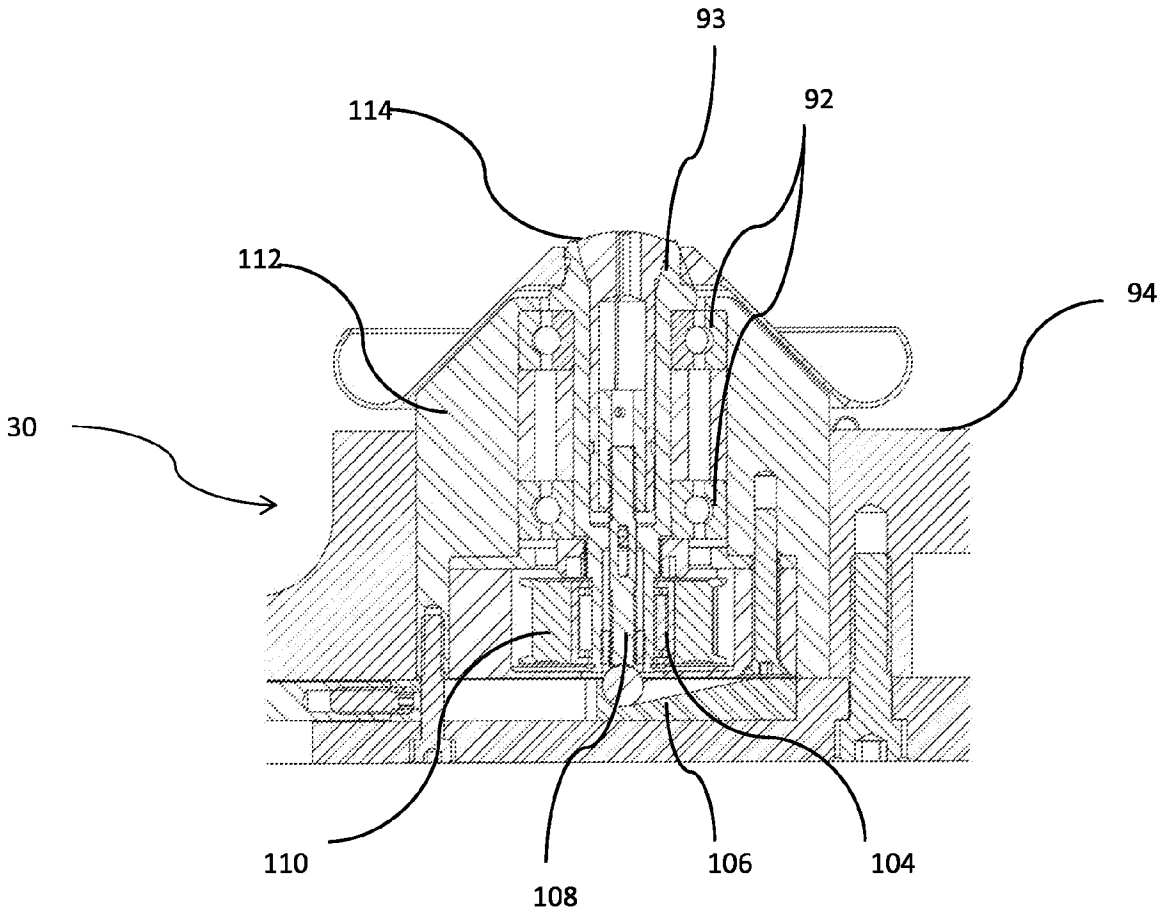
FIG. 9 is cross-sectional side view of the lower unit.

FIG. 9 shows a magnified cross sectional view of the lower unit 30. The lower unit 30 includes main spindle 93 and can accommodate the entire series of D size collets and other D-size based tooling, such as multiple jaw chucks, step collets, plug collet blanks and the like. Plug collets can be machined to suit a plurality of purposes. Plug collets are of the same basic shape as regular collets described earlier in this document, they are, however, a completely solid shape and come in a variety of materials, allowing manufacturers to configure the shape required for a particular job.

The lower unit 30 also supports quick collet 114 tooling change by means of a collet draw bar 108. Pulling a collet closer knob 76 (shown in FIG. 7) out of the base releases the collet 114 which can then be removed by turning it counter-clockwise. Placing collets 114 or any other D-sized tooling is accomplished by lowering them into the lower unit main spindle 93, turning them clockwise onto the internal drawbar and firmly pushing collet closer knob 76 attached to a slide 106 back into the base. This action releases spring loaded draw bar 108 which pulls down the collet 114 into the conical seat of the lower unit main spindle 93.

The collet system comprises a pull/push rod attached to a grooved slide 106 in which a sphere can roll back and forth. When the rod is pulled out from the base of the device, the slide 106 transitions from deep to very shallow, causing the sphere to rise upward. In this process, the sphere contacts the spring loaded collet draw bar 108, which in turn lifts the collet 114 for removal from the spindle. When the rod is pushed back into the machine base, the groove in the slide 106 deepens and allows the sphere to retract downward, which in turn releases the pressure on the spring loaded collet draw bar 108. This release allows the spring loaded drawbar to pull the collet 114 (46/s4) into the conical seat of the spindle nose and close around the object of choice.

The lower unit main spindle 93 is designed to rotate free of play, axially or radially, through the use of a set of super precision pre-loaded angular contact bearings 92. Internally, a lower unit drive pulley 110 for a precision timing belt is connected to the lower unit main spindle 93 by means of an over running clutch 104 allowing the lower unit main spindle 93 to be rotated by hand in the driven direction only while lapping machine 100 is in a holding pattern. The overrunning clutch is necessary to remove excess charging material prior to starting a new lapping cycle. The lower unit main spindle 93 is driven by a precision timing belt tensioned by a free running eccentric tension adjustment for trouble free and quiet operation. The belt is an "off the shelf" precision timing belt, readily available and simple to install.

A diamond trap 52 is attached to lower unit main spindle 93 and traps excess slurry through centrifugal force inside the lip of diamond trap 52, which turns back on itself, thereby creating a small reservoir. Atop the lower unit main spindle 93 rests a removable diamond trap 52 with a turned-in lip which prevents accumulated residual slurry to be expelled during rotation, thereby maintaining a clean operation environment. During the initial phases of the application of lapping compound to the surfaces to be lapped, it is critical that excess compound be removed. For this reason, the drive mechanism of the lower unit main spindle 93 is equipped with an overrunning clutch which allows the operator to turn the lower unit main spindle 93, even though the drive motor is held in a positive break for the removal of excess lapping compound. Additionally, diamond trap 52 is removable for cleaning, and is exchangeable for a larger size if needed.

Figure 10:
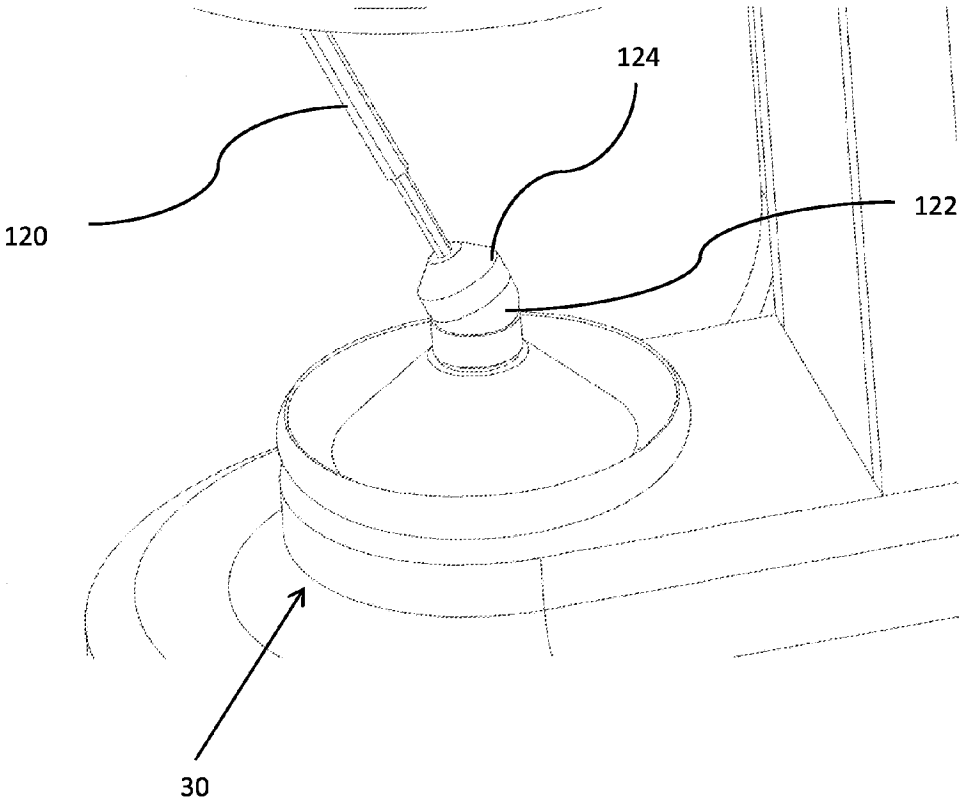
FIG. 10 is a perspective view of the lower unit and the telescopic rod.
Figure 11B:
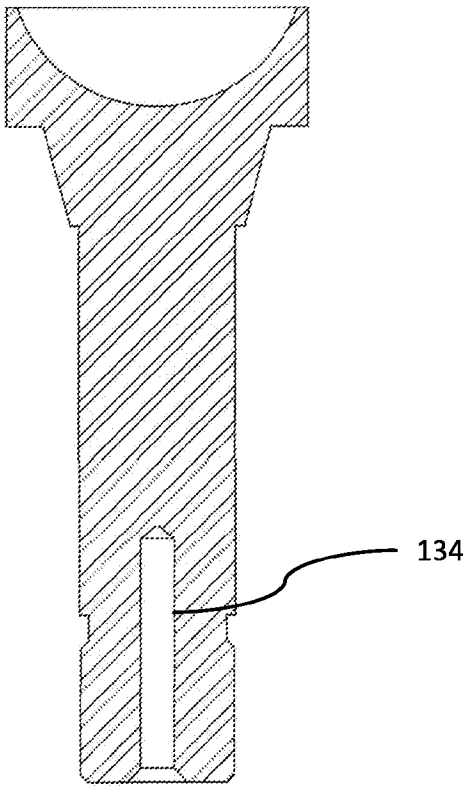
FIG. 11B is a cross sectional side view of the lower concave lap.
Figure 11A:
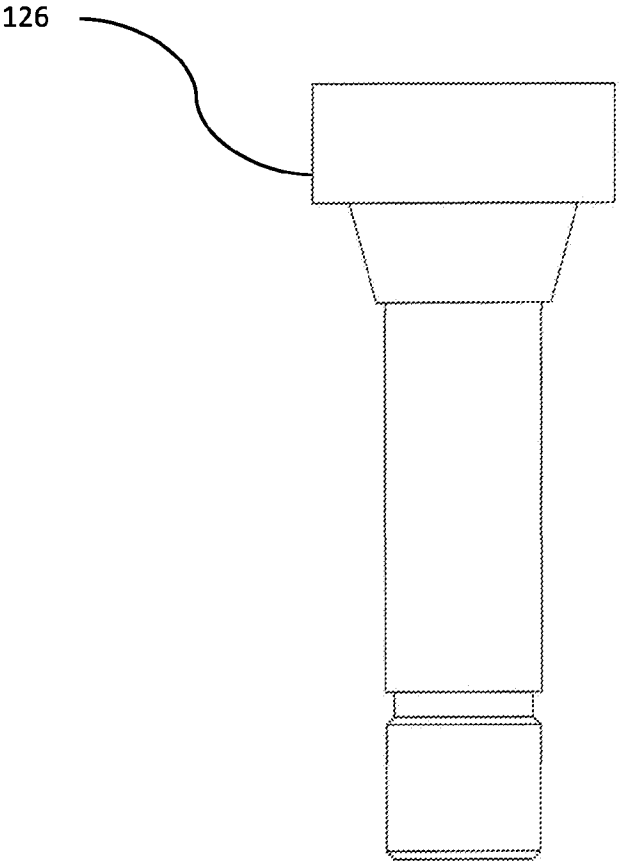
FIG. 11A is a side view of the lower concave lap.
Figure 12:
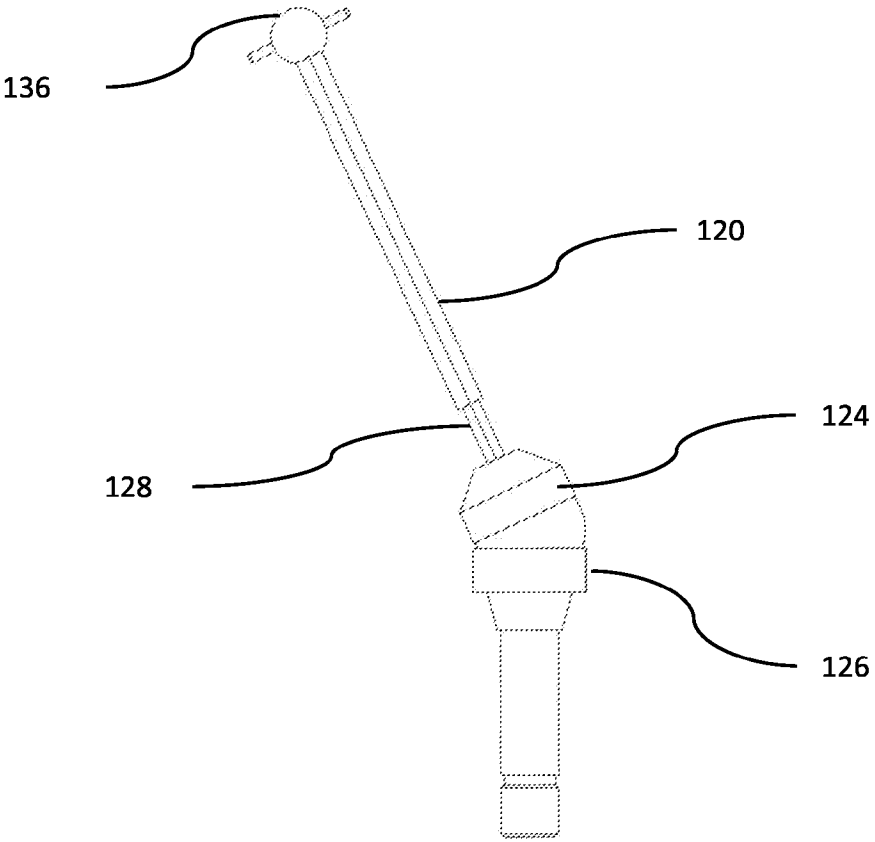
FIG. 12 is a side view of telescopic rod in conjunction with the upper and lower concave lap.

FIG. 10 shows a magnified perspective view of lower unit 30 including telescopic rod 120, upper concave lap 124, workpiece 122. FIGS. 11A and B illustrate the lower concave lap 126 including threaded collet drawbar hole 134. FIG. 12 shows the telescope knuckle sphere 136 which is inserted into universal telescopic rod socket 132 (shown in FIG. 13).

Figure 13:
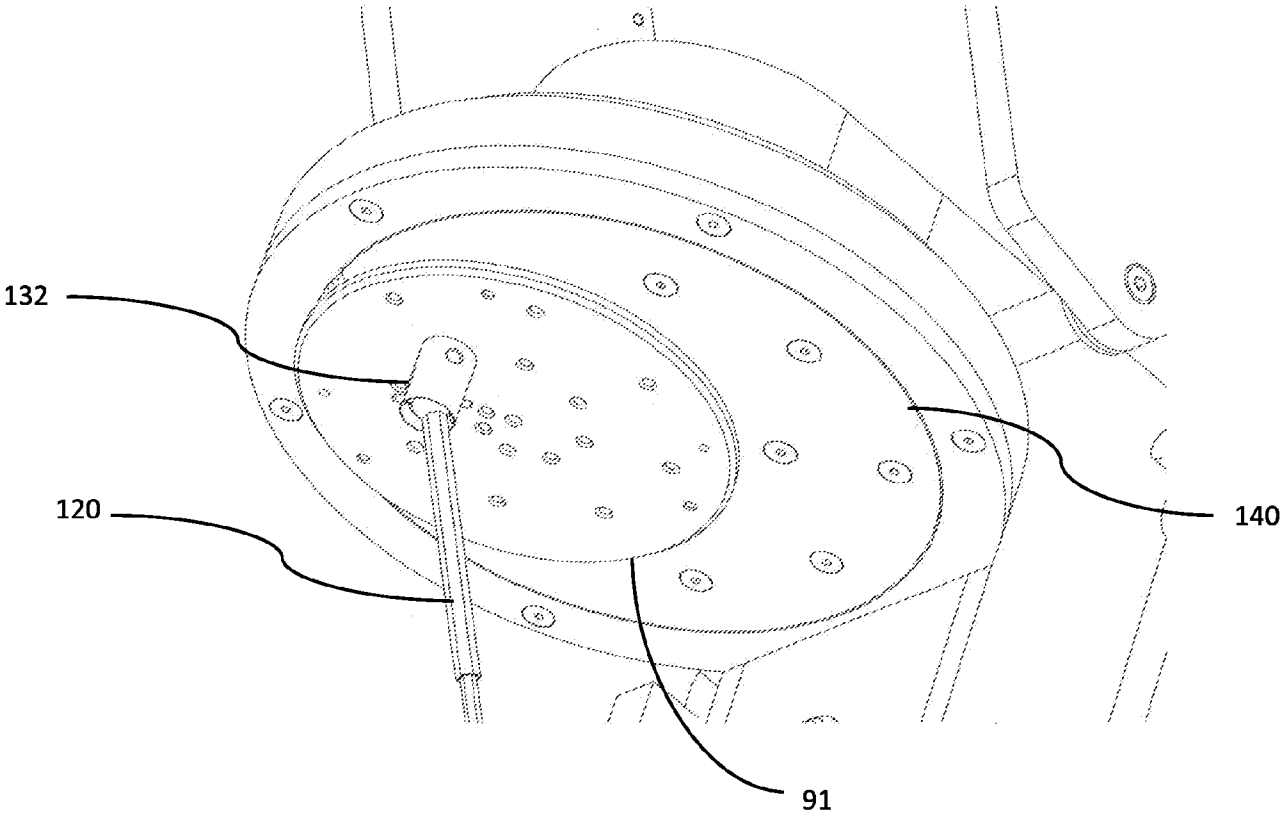
FIG. 13 is a bottom perspective view of the upper unit.
Figure 14:
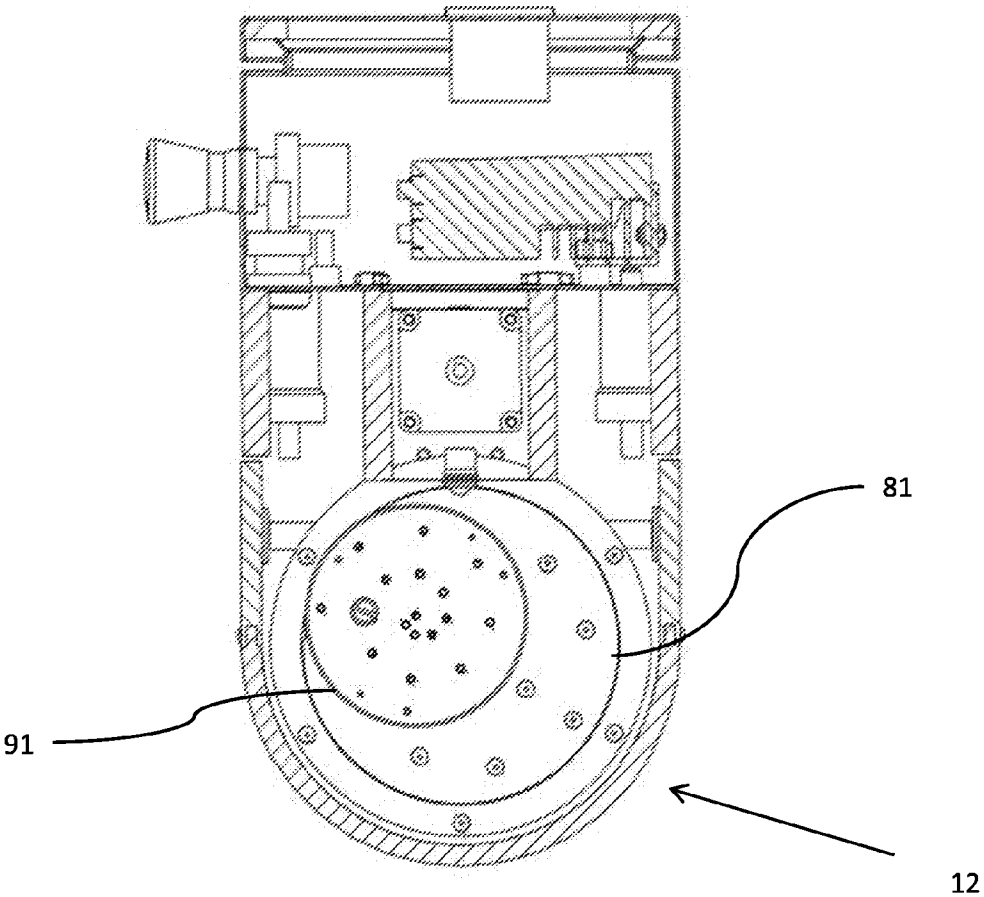
FIG. 14 is a bottom view of the upper unit.

FIG. 13 shows telescope knuckle sphere 136 inserted into universal telescopic rod socket 132. The universal telescopic rod socket 132, together with the spherical and cross-pinned end of the spring-loaded telescopic rod 120 creates a very low friction universal swivel joint in every direction. This configuration ensures smooth progression though the complex motion path of the elliptical gear train and thus enhances product quality significantly. Universal telescopic rod socket 132 is removably attached to orbital disc 91 beneath cover plate 140, as also shown in FIG. 14, illustrating a bottom view of upper unit 12.

Figure 15:
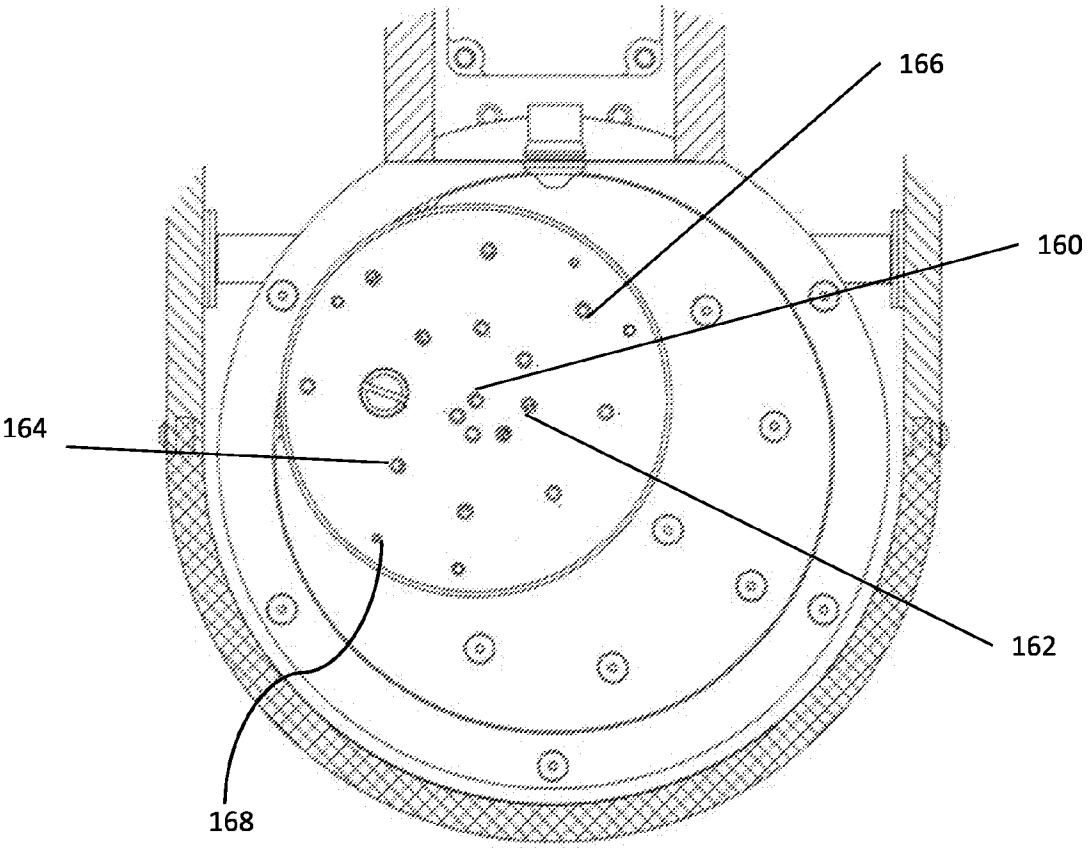
FIG. 15 is a magnification of the bottom view of the upper unit.
Figure 16A:
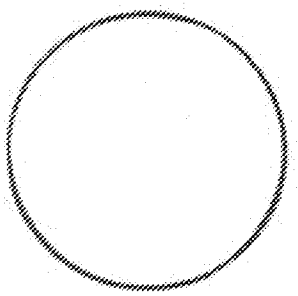
FIGS. 16 A-D illustrate patterns of rotation created by selected aperture positions on the orbital disc.
Figure 16B:
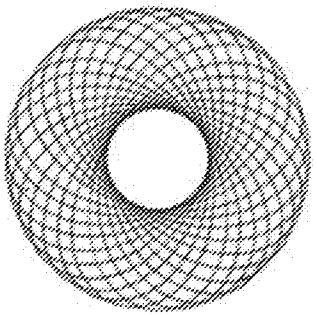
Figure 16C:
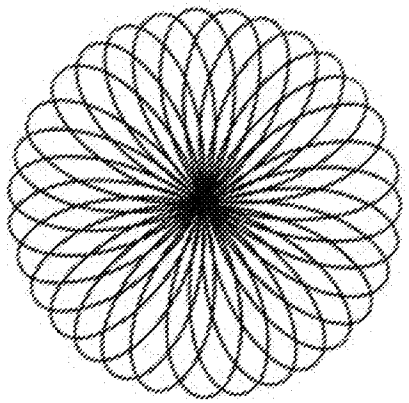
Figure 16D:
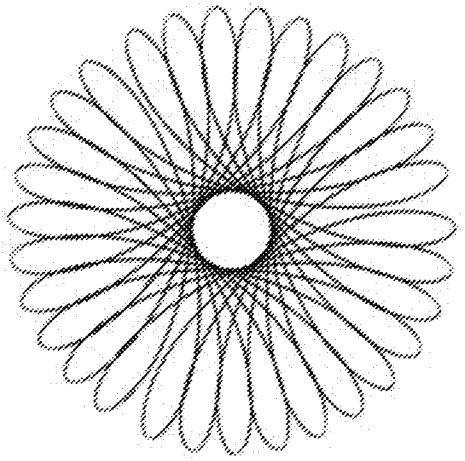

FIG. 15 shows first aperture position 160, fifth aperture position 162, tenth aperture position 164 and 14th aperture position 166. FIG. 15 also shows alignment pin 168.

FIGS. 16A-D shows roulette curve lapping patterns resulting from removable attachment of universal telescopic rod socket 132 to selected apertures, which, in the preferred embodiment, are threaded apertures. The pattern depicted in FIG. 16A results from a connection of telescopic rod 120 to first aperture position 160. The pattern depicted in FIG. 16B results from a connection of telescopic rod 120 to fifth aperture position 162. The pattern depicted in FIG. 16C results from a connection of telescopic rod 120 to tenth aperture position 164. The pattern depicted in FIG. 16D results from connection of telescopic rod 120 to 14th aperture position 166.

Figure 17B:
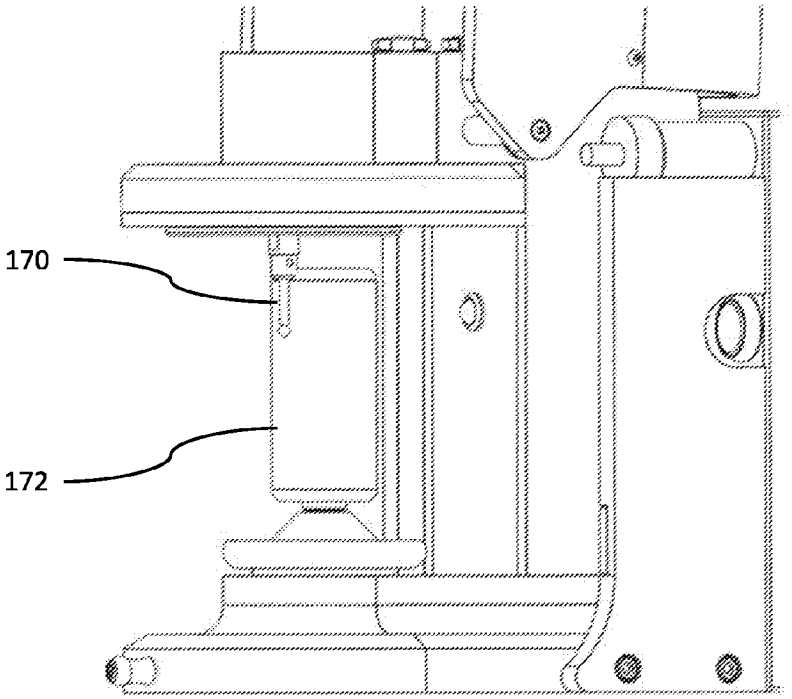
FIGS. 17A and 17B show a side view of a CMM probe and the lapping machine.
Figure 17A:
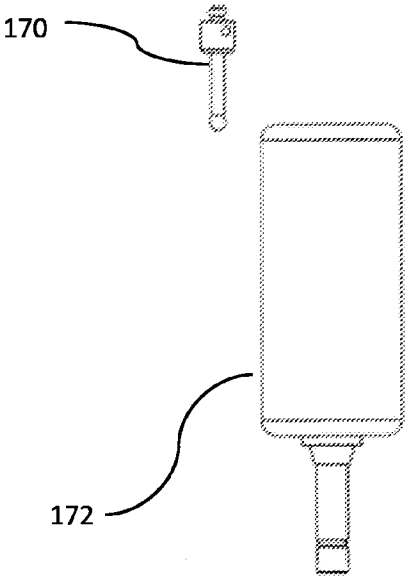

FIGS. 17A and 17B show alternative embodiments of the lapping machine of the present disclosure configured to reconstitute CMM probes 170 of variable lengths and/or tip diameters. In this alternative embodiment, a cotton thread wheel 172 is attached to a D size collet and placed into lower unit 30 and CMM probe 170 is connected to orbital disc 91. For this reconstitution process only position 1 can be used, as it is the only position on the orbital disk 91 that follows an exact circular path around the center of the lower unit 30.

Figure 18B:
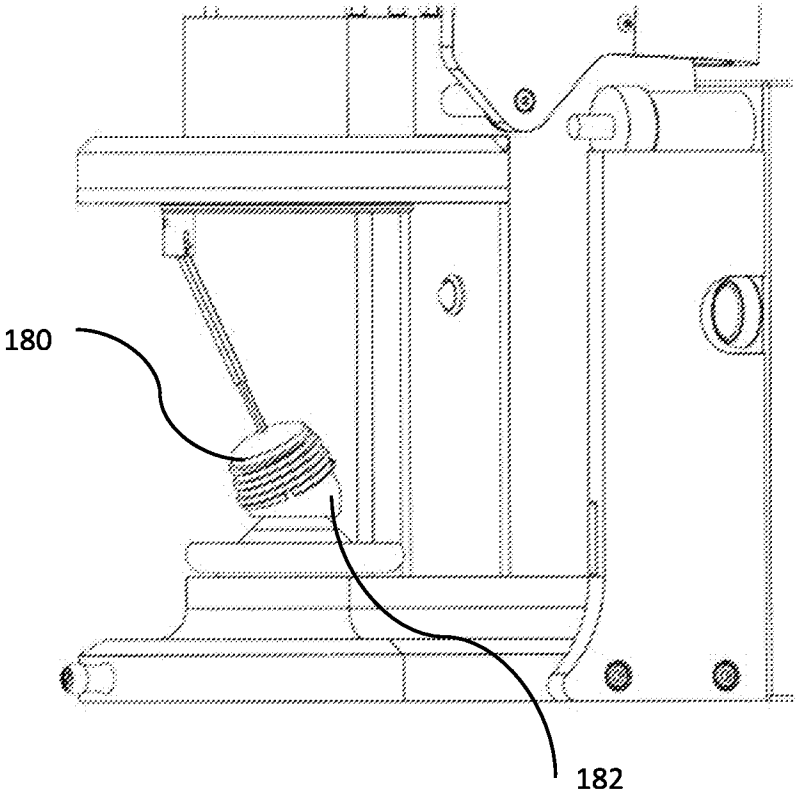
FIGS. 18A and 18B show a side view of a hip prosthetic joint and the lapping machine.
Figure 18A:
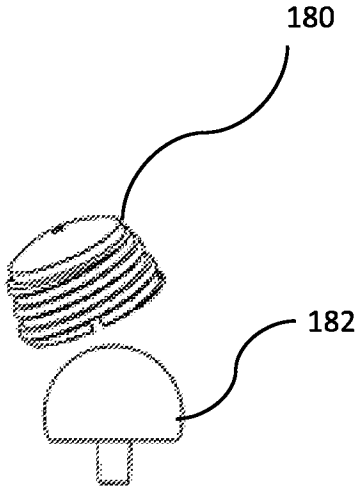

FIGS. 18A and 18B additional embodiments for use with elements of a hip prosthesis. Here, hip prosthesis acetabular cup 180 is attached to orbital disc 91 by means of spring-loaded telescope 120 and hip prosthesis head 182 held by a collet attached to lower unit 30.

Although the disclosure has been described with reference to certain preferred embodiments, it will be appreciated by those skilled in the art that modifications and variations may be made without departing from the spirit and scope of the disclosure. It should be understood that applicant does not intend to be limited to the particular details described above and illustrated in the accompanying drawings.

What is claimed is:

1. A lapping machine for lapping generally spherical surfaces, comprising:

a lower workpiece contact portion; an upper workpiece contact portion; a mounting for a lower workpiece contact portion; a telescopic rod attached to said upper workpiece contact portion; wherein said telescopic rod is removably attached to an orbital disc; said orbital disc having an at least one aperture; wherein said telescopic rod is indirectly connected to the at least one aperture in the orbital disc and is configured to move in conjunction with the at least one aperture in said orbital disc; and wherein said at least one aperture moves in a pattern describing a roulette curve, thereby causing a workpiece to be lapped in said pattern describing a roulette curve.

2. The lapping machine of claim 1 further comprising a ring gear having a plurality of internally directed primary gear teeth forming a generally circular shape; said orbital disc having externally directed secondary gear teeth in mesh with the primary gear teeth; a motor to drive the movement of said secondary gear teeth relative to said primary gear teeth; the movement of said secondary gear teeth inducing movement in the pattern describing a roulette curve to an upper workpiece contact portion.

3. The lapping machine of claim 1 wherein the upper workpiece contact portion is configured to permit a relative movement between the upper workpiece contact portion and the workpiece.

4. The lapping machine of claim 1 wherein the at least one aperture is configured to receive a universal telescopic rod socket; said universal telescopic rod socket being in removable contact with said telescopic rod; said telescopic rod having two ends, a lap end and a disc end; wherein said disc end of said telescopic rod is in removable contact with said universal telescopic rod socket; wherein said lap end of said telescopic rod is in removable contact with said upper workpiece contact portion; said telescopic rod containing a spring; wherein said telescopic rod comprises an outer, upper rod piece and an inner, lower rod piece; said telescoping rod further comprising a spring; wherein said spring is contained within the telescopic rod and is in contact with the upper rod piece and the lower rod piece; wherein said telescopic rod is configured to provide continuous pressure on said workpiece.

5. The lapping machine of claim 1 further comprising a plurality of apertures in said orbital disc.

6. The lapping machine of claim 1, wherein a plurality of apertures are arranged in a predetermined spaced relationship both circumferentially and radially.

7. The lapping machine of claim 6 wherein the plurality of apertures are spirally disposed.

8. The lapping machine of claim 1 wherein the lower workpiece contact portion is a lower concave lap.

9. The lapping machine of claim 1 wherein the upper workpiece contact portion is an upper concave lap having a spherically curved surface of the same radius as a surface of said workpiece.

10. The lapping machine of claim 9 wherein the upper concave lap has a spherically curved surface of the same radius as the surface of said workpiece.

11. The lapping machine of claim 1 further comprising an elliptical gear drive train.

12. The lapping machine of claim 1 wherein the orbital disc is a rod-accepting disc having a plurality of threaded apertures configured to accept the telescopic rod.

13. The lapping machine of claim 1 wherein the orbital disc is attached to a combination gear.

14. The lapping machine of claim 4 wherein said upper rod piece is slidable over said lower rod piece.

15. The lapping machine of claim 1 further comprising a removable diamond trap with a turned-in lip.

16. A lapping machine for lapping generally spherical surfaces, comprising a lower workpiece contact portion; an upper workpiece contact portion; a mounting for a lower workpiece contact portion; a telescopic rod attached to said upper workpiece contact portion; wherein an at least one aperture is configured to receive a universal telescopic rod socket; said universal telescopic rod socket being in removable contact with said telescopic rod; said telescopic rod having two ends, a lap end and a disc end; wherein said disc end of said telescopic rod is in removable contact with said universal telescopic rod socket; wherein said lap end of said telescopic rod is in removable contact with said upper workpiece contact portion; said disc end of said telescopic rod terminating proximal to an orbital disc; said telescopic rod comprising a spring; wherein said telescopic rod further comprises an outer, upper rod piece and an inner, lower rod piece; wherein the spring is contained within the telescopic rod and is in contact with upper rod piece and the lower rod piece; wherein said telescopic rod is configured to provide continuous pressure on said workpiece; wherein said telescopic rod is removably connected to the orbital disc; said orbital disc having an at least one aperture; wherein movement of the telescopic rod is dependent on said telescopic rod being connected to one of the at least one aperture in said orbital disc; wherein said at least one aperture moves in a pattern describing a roulette curve; said lapping machine further comprising a ring gear having a plurality of internally directed primary gear teeth forming a generally circular shape; said orbital disc having externally directed secondary gear teeth; the primary gear teeth and the secondary gear teeth being in mesh; a motor to drive the movement of said secondary gear teeth relative to said primary gear teeth; the movement of said secondary gear teeth inducing a pattern describing a roulette curve to said telescoping rod; and wherein said plurality of apertures are located at a predetermined distance from a rotational center of the orbital disc.

17. The lapping machine of claim 16 wherein a drive gear engages a set of first gears.

18. A method of lapping of lapping generally spherical objects comprising:

(a) providing a lapping machine with a lap having at least one spherical lapping surface;

(b) connecting the lap to an orbital disc;

(c) holding a workpiece in a single location and in continual contact with the spherical lap;

(d) moving the spherical lap relative to the workpiece in a pattern describing a roulette curve.

19. The method of claim 18 further comprising, (a) providing an upper spherical lap connected to a rod;

(b) connecting a rod to a location on an orbital disc;

(c) applying continual pressure to the workpiece from said rod;

(d) moving said orbital disc in a circular pattern at a constant rate in a horizontal plane while rotating said orbital disc at a constant rate about a vertical axis.

20. The method of claim 19, wherein the rod is a spring-loaded telescopic rod.

* * * * *